US009761950B2

(12) United States Patent
Cook et al.

(10) Patent No.: US 9,761,950 B2
(45) Date of Patent: Sep. 12, 2017

(54) DIELECTRIC WAVEGUIDE WITH EMBEDDED ANTENNA

(71) Applicant: Texas Instruments Incorporated, Dallas, TX (US)

(72) Inventors: Benjamin S. Cook, Dallas, TX (US); Juan Alejandro Herbsommer, Allen, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 229 days.

(21) Appl. No.: 14/521,443

(22) Filed: Oct. 22, 2014

(65) Prior Publication Data

US 2015/0295307 A1 Oct. 15, 2015

Related U.S. Application Data

(60) Provisional application No. 61/977,404, filed on Apr. 9, 2014.

(51) Int. Cl.

| | |
|---|---|
| ***H01Q 1/50*** | (2006.01) |
| ***H01Q 9/16*** | (2006.01) |
| ***H01P 11/00*** | (2006.01) |
| ***H01P 3/12*** | (2006.01) |
| ***H01P 5/08*** | (2006.01) |
| ***H01Q 1/40*** | (2006.01) |
| *H01P 3/16* | (2006.01) |

(52) U.S. Cl.

CPC ..... *H01Q 9/16* (2013.01); *H01P 3/122* (2013.01); *H01P 5/087* (2013.01); *H01P 11/006* (2013.01); *H01Q 1/40* (2013.01); *H01P 3/16* (2013.01)

(58) Field of Classification Search

CPC .. H01Q 9/16; H01Q 1/40; H01P 3/122; H01P 5/087; H01P 11/006; H01P 3/16

USPC ..... 343/785, 795

See application file for complete search history.

(56) References Cited

U.S. PATENT DOCUMENTS

| | | | | |
|---|---|---|---|---|
| 4,825,221 | A * | 4/1989 | Suzuki | H01P 3/16 333/239 |
| 2007/0087564 | A1* | 4/2007 | Speakman | H01G 9/2031 438/674 |
| 2008/0238796 | A1* | 10/2008 | Rofougaran | H01Q 1/005 343/776 |
| 2012/0206311 | A1* | 8/2012 | Lee | H01Q 13/06 343/785 |

(Continued)

OTHER PUBLICATIONS

"3D Printing", Wikipedia, pp. 1-35, available at http://en.wikipedia.org/w/index.php?title=3D_printing&oldid=624190184 on Sep. 4, 2014.

(Continued)

*Primary Examiner* — Dameon E Levi
*Assistant Examiner* — David Lotter
(74) *Attorney, Agent, or Firm* — John Pessetto; Charles A. Brill; Frank D. Cimino

(57) ABSTRACT

A digital system has a dielectric core waveguide that has a longitudinal dielectric core member. The core member has a body portion and may have a cladding surrounding the dielectric core member. A radiated radio frequency (RF) signal may be received on a first portion of a radiating structure embedded in the end of a dielectric waveguide (DWG). Simultaneously, a derivative RF signal may be launched into the DWG from a second portion of the radiating structure embedded in the DWG.

15 Claims, 10 Drawing Sheets

(56) References Cited

U.S. PATENT DOCUMENTS

2013/0278360 A1* 10/2013 Kim ..... H04B 5/0031
333/239
2015/0226918 A1* 8/2015 Bauters ..... H01L 31/105
385/14

OTHER PUBLICATIONS

Juan Alejandro Herbsommer, et al, "Dielectric Waveguide Manufactured Using Printed Circuit Board Technology", U.S. Appl. No. 13/854,935, filed Apr. 1, 2013, pp. 1-69.
Juan Alejandro Herbsommer, "Dielectric Waveguide Signal Divider", U.S. Appl. No. 14/498,512, filed Sep. 26, 2014, pp. 1-24.
C. Yeh and F.I. Shimabukuro, "The Essence of Dielectric Waveguides", Springer Science + Business Media, LLC, New York, New York, Jun. 2008, pp. 46-47.

* cited by examiner

DIELECTRIC WAVEGUIDE WITH EMBEDDED ANTENNA

CLAIM OF PRIORITY UNDER 35 U.S.C. 119(e)

The present application claims priority to and incorporates by reference U.S. Provisional Application No. 61/977,404 filed Apr. 9, 2014, entitled "Direct-Write Printing of Dielectric Waveguides with an Antenna Interface sub-THz Signals."

FIELD OF THE INVENTION

This invention generally relates to wave guides for high frequency signals, and in particular to waveguides with dielectric cores.

BACKGROUND OF THE INVENTION

In electromagnetic and communications engineering, the term waveguide may refer to any linear structure that conveys electromagnetic waves between its endpoints. The original and most common meaning is a hollow metal pipe used to carry radio waves. This type of waveguide is used as a transmission line for such purposes as connecting microwave transmitters and receivers to their antennas, in equipment such as microwave ovens, radar sets, satellite communications, and microwave radio links.

A dielectric waveguide employs a solid dielectric core rather than a hollow pipe. A dielectric is an electrical insulator that can be polarized by an applied electric field. When a dielectric is placed in an electric field, electric charges do not flow through the material as they do in a conductor, but only slightly shift from their average equilibrium positions causing dielectric polarization. Because of dielectric polarization, positive charges are displaced toward the field and negative charges shift in the opposite direction. This creates an internal electric field which reduces the overall field within the dielectric itself. If a dielectric is composed of weakly bonded molecules, those molecules not only become polarized, but also reorient so that their symmetry axis aligns to the field. While the term "insulator" implies low electrical conduction, "dielectric" is typically used to describe materials with a high polarizability; which is expressed by a number called the relative permittivity ($\in k$). The term insulator is generally used to indicate electrical obstruction while the term dielectric is used to indicate the energy storing capacity of the material by means of polarization.

Permittivity is a material property that expresses a measure of the energy storage per unit meter of a material due to electric polarization (J/V^2)/(m). Relative permittivity is the factor by which the electric field between the charges is decreased or increased relative to vacuum. Permittivity is typically represented by the Greek letter $\in$. Relative permittivity is also commonly known as dielectric constant.

Permeability is the measure of the ability of a material to support the formation of a magnetic field within itself in response to an applied magnetic field. Magnetic permeability is typically represented by the Greek letter $\mu$.

The electromagnetic waves in a metal-pipe waveguide may be imagined as travelling down the guide in a zig-zag path, being repeatedly reflected between opposite walls of the guide. For the particular case of a rectangular waveguide, it is possible to base an exact analysis on this view. Propagation in a dielectric waveguide may be viewed in the same way, with the waves confined to the dielectric by total internal reflection at its surface.

BRIEF DESCRIPTION OF THE DRAWINGS

Particular embodiments in accordance with the invention will now be described, by way of example only, and with reference to the accompanying drawings.

Figure 1:
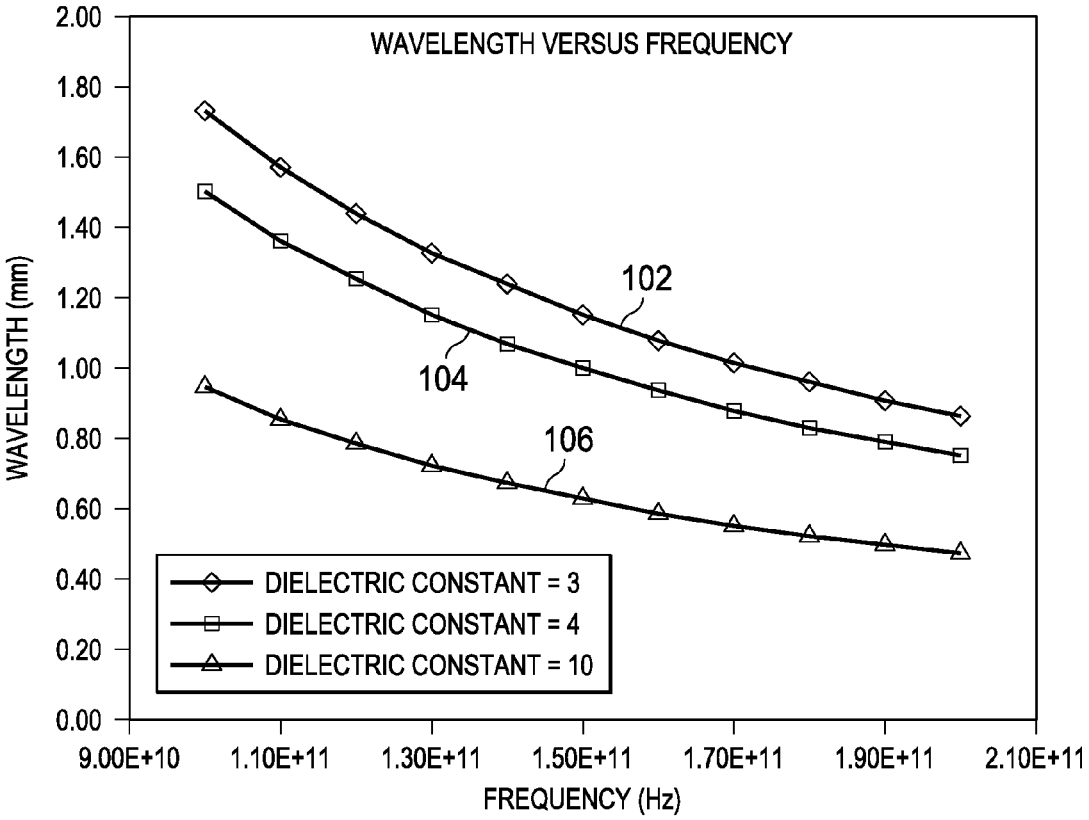
FIG. 1 is a plot of wavelength versus frequency through materials of various dielectric constants.

Other features of the present embodiments will be apparent from the accompanying drawings and from the detailed description that follows.

DETAILED DESCRIPTION OF EMBODIMENTS OF THE INVENTION

Specific embodiments of the invention will now be described in detail with reference to the accompanying figures. Like elements in the various figures are denoted by like reference numerals for consistency. In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

As frequencies in electronic components and systems increase, the wavelength decreases in a corresponding manner. For example, many computer processors now operate in the gigahertz realm. As operating frequencies increase subterahertz, the wavelengths become short enough that signal lines that exceed a short distance may act as an antenna and signal radiation may occur. FIG. 1 is a plot of wavelength versus frequency through materials of various dielectric constants. As illustrated by plot 102 which represents a material with a low dielectric constant of 3, such as a printed circuit board, a 100 GHz signal will have a wavelength of approximately 1.7 mm. Thus, a signal line that is only 1.7 mm in length may act as a full wave antenna and radiate a significant percentage of the signal energy. In fact, even lines of $\lambda/10$ are good radiators, therefore a line as short as 170 um may act as a good antenna at this frequency.

Waves in open space propagate in all directions, as spherical waves. In this way they lose their power proportionally to the square of the distance; that is, at a distance R from the source, the power is the source power divided by R2. A wave guide may be used to transport high frequency signals over relatively long distances. The waveguide confines the wave to propagation in one dimension, so that under ideal conditions the wave loses no power while propagating. Electromagnetic (EM) wave propagation along the axis of the waveguide is described by the wave equation, which is derived from Maxwell's equations, and where the wavelength depends upon the structure of the waveguide, and the material within it (air, plastic, vacuum, etc.), as well as on the frequency of the wave. Commonly-used waveguides are only of a few categories. The most common kind of waveguide is one that has a rectangular cross-section, one that is usually not square. It is common for the long side of this cross-section to be twice as long as its short side. These are useful for carrying electromagnetic waves that are horizontally or vertically polarized.

For the exceedingly small wavelengths encountered for sub-THz radio frequency (RF) signals, dielectric waveguides perform well and are much less expensive to fabricate than hollow metal waveguides. Furthermore, a metallic waveguide has a frequency cutoff determined by the size of the waveguide. Below the cutoff frequency there is no propagation of the electromagnetic field. Dielectric waveguides may have a wider range of operation without a fixed cutoff point. However, a purely dielectric waveguide may be subject to interference caused by touching by fingers or hands, or by other conductive objects. Metallic waveguides confine all fields and therefore do not suffer from EMI (electromagnetic interference) and cross-talk issues; therefore, a dielectric waveguide with a metallic cladding may provide significant isolation from external sources of interference. Various types of dielectric core waveguides will be described in more detail below.

Various configurations of dielectric waveguides (DWG) and interconnect schemes are described in U.S. patent application Ser. No. 13/854,935 filed Apr. 1, 2013, entitled "Dielectric Waveguide Manufactured Using Printed Circuit Board Technology" and are incorporated by reference herein. Various antenna configurations for launching and receiving radio frequency signals to/from a DWG are also described therein and are incorporated by reference herein.

Embodiments of the invention provide proximity coupling and/or impedance matching for sub_THz frequencies in a dielectric waveguide and an interfacing object, such as: another waveguide, an IC, etc., for example. This may be accomplished by utilizing impedance matched radiating elements embedded within the waveguide. Highly-efficient proximity coupling may be achieved by incorporating radiating elements into the ends of dielectric waveguides. Impedance matching between multiple waveguide sections or waveguides and IC's may also become much simpler when a radiating element is incorporated into the end of a dielectric waveguide.

Figure 2:
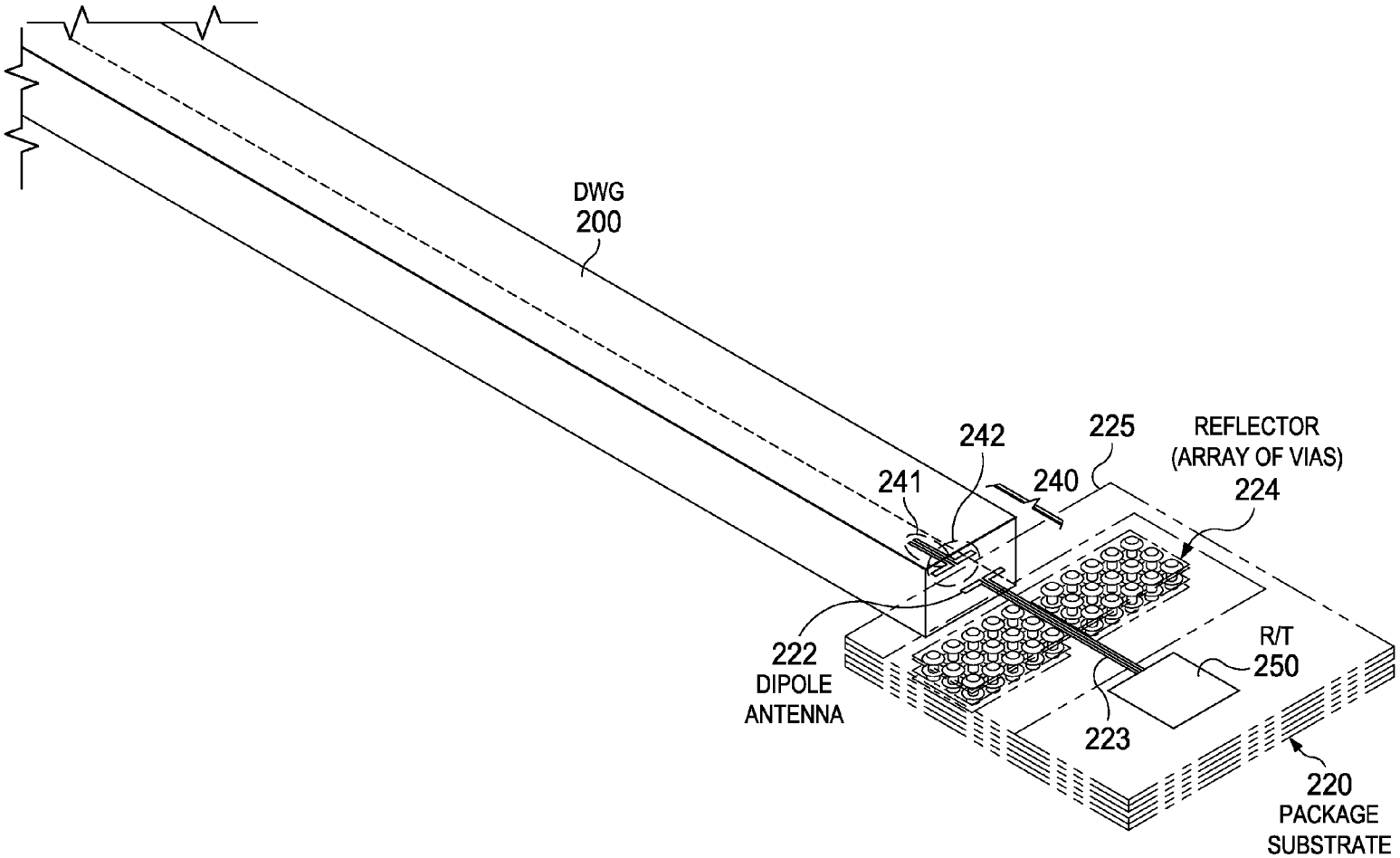

FIG. 2 illustrates system that includes a waveguide 200 that has a dipole antenna structure 242 and radiating elements 241 embedded near and end of waveguide 200. In this example system, an integrated circuit (IC) includes high frequency circuitry 250 that produces a signal that is connected to a dipole antenna 222 that is configured to launch an electromagnetic signal into an adjacent DWG 200. In this example, high frequency circuitry 250 is a transceiver that includes both a transmitter and receiver coupled to the same dipole antenna; however, in another embodiment high frequency circuitry 250 may only include a transmitter or only a receiver. In this example, substrate 220 may be part of the IC, or the IC may be mounted on substrate 220. An edge of substrate 220 forms an interface area 225 where the dipole antenna is positioned. A microstrip line 223 couples the dipole antenna to high frequency circuitry 250. A reflector 224 is provided to cause electromagnetic energy that radiates from the back side of dipole antenna 222 to be reflected back towards DWG 200 in order to improve signal coupling into DWG 200. DWG 200 will typically have an outer layer, but for simplicity the outer layer is not shown in this illustration. The outer layer may be another dielectric material that has a lower dielectric constant value than the core, or the outer layer may be a metallic or otherwise conductive layer, for example.

A flexible waveguide configuration may have a core member made from flexible dielectric material with a high dielectric constant and be surrounded with a cladding made from flexible dielectric material with a low dielectric constant. Similarly, a rigid waveguide configuration may have a core member made from rigid dielectric material with a high dielectric constant and be surrounded with a cladding made from dielectric material with a low dielectric constant. While theoretically, air could be used in place of the cladding, since air has a dielectric constant of approximately 1.0, any contact by humans, or other objects may introduce serious impedance mismatch effects that may result in signal loss or corruption. Therefore, typically free air does not provide a suitable cladding.

As mentioned above, it is beneficial to match the impedance of a dielectric waveguide with its launching mechanism, such as dipole antenna 222 in this example. This is necessary in order to allow an optimum power transfer of the signal between the antenna and the dielectric waveguide. Polymer material commonly used to fabricate the dielectric core of a waveguide has a dielectric constant value that is typically in the range of 2.4-12, with lower values being more common and therefore less expensive. The impedance of a DWG using a commonly available polymer material having a dielectric constant of approximately 3.0 for signals in the range of 100 GHz may be approximately 200-500 ohms depending on permittivity, permeability, and overall size and shape of the dielectric core. A dipole antenna such as antenna 222 may have a characteristic impedance of approximately 73 ohms, for example. Such a mismatch in impedance may reduce the coupling efficiency between antenna 222 and a typical DWG.

In this example, DWG 200 has a dipole antenna 242 embedded in the end of DWG 200. Dipole antenna 242 is designed to have an impedance of approximately 73 ohms and therefore matches the impedance of dipole antenna 222. Parallel radiating elements 241 may be configured to have an impedance in the range of 200-500 ohms and thereby match the impedance of DWG 200. This configuration allows dipole antenna 242 to couple to dipole antenna 222 and receive or transmit sub THz signals produced or received by high frequency circuitry 250, for example. Dipole antenna 242 and radiating elements 241 will be collectively referred to herein as radiating element 240.

In this example, dipole antenna 222 is a half-wave dipole antenna which is an efficient dipole design. In order to design a half-wavelength dipole antenna, the dielectric constant of the environment around the antenna should be calculated or simulated to determine an effective dielectric constant value for the region around the antenna. The total length of the dipole antenna may then be selected to be a half wavelength at the frequency of operation (center of band) at this particular or effective dielectric constant. The effective dielectric constant to use for the antenna design is the effective dielectric constant that the antenna "sees" around it. If the antenna is in free space the effective dielectric constant is 1. If the antenna is embedded by an infinite polymer then the effective dielectric constant is the one of the dielectric. In this case, the antenna is embedded in a finite DWG so the effective dielectric constant will be somewhat different than that of the dielectric constant of the DWG due to the air or other material surrounding the DWG.

In general, an efficient embedded radiating element will have dimensions in the order of, or a substantial fraction of, the wavelength of the EM radiation at that frequency in an effective dielectric constant affected not only by the material in which the antenna is embedded to but also by its surroundings assuming that the DWG has a finite dimension and the antenna is close to the end of the DWG. Equation (1) provides a rough estimate for the largest dimension L of half-wave dipole antenna 242.

$$L = \frac{\frac{\lambda}{2}}{\sqrt{\varepsilon_\text{effective}}} \tag{1}$$

where lambda is the free space wavelength, and epsilon_effective is the average of the material permittivities in the surrounding space.

Since dipole antenna 242 is hardwired to radiating elements 241, a signal received on dipole antenna 242 may then be launched into DWG 200 by radiating elements 241. Similarly, a signal traveling along DWG 200 may be captured by radiating elements 241 and then be radiated by dipole antenna 242. In this manner, coupling efficiency between DWG 200 and signal launching mechanism 222 may be improved.

In another embodiment, two DWG segments may be efficiently coupled end to end by providing an embedded antenna structure connected to a radiating element in the end portion of each DWG segment. In this case, both DWG segments may have an antenna structure 242 connected to a radiating element 241, for example.

Figure 3:
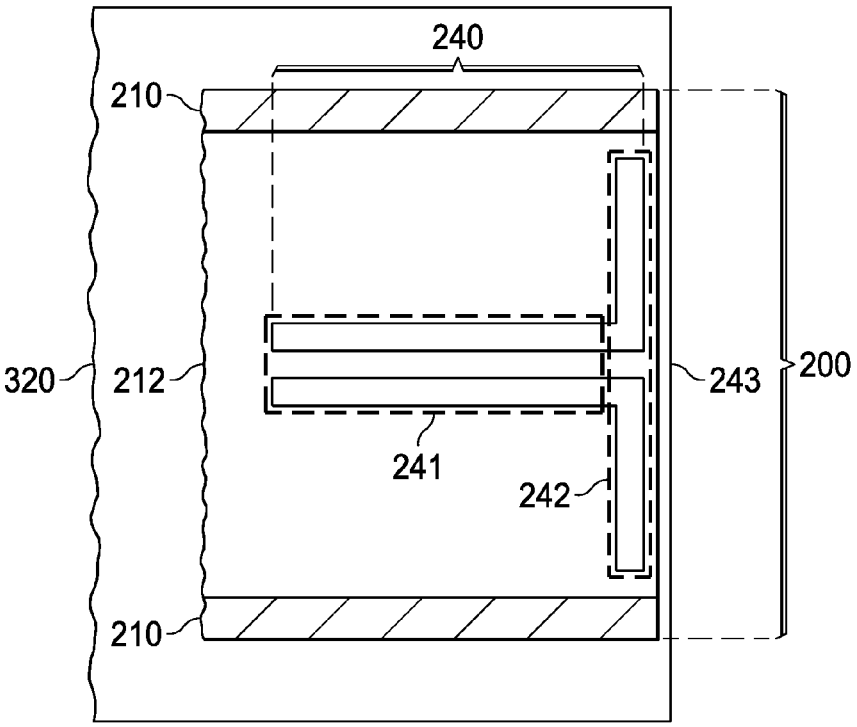
FIG. 2-4 are illustrations of a waveguide with an embedded radiating structure.
Figure 4:
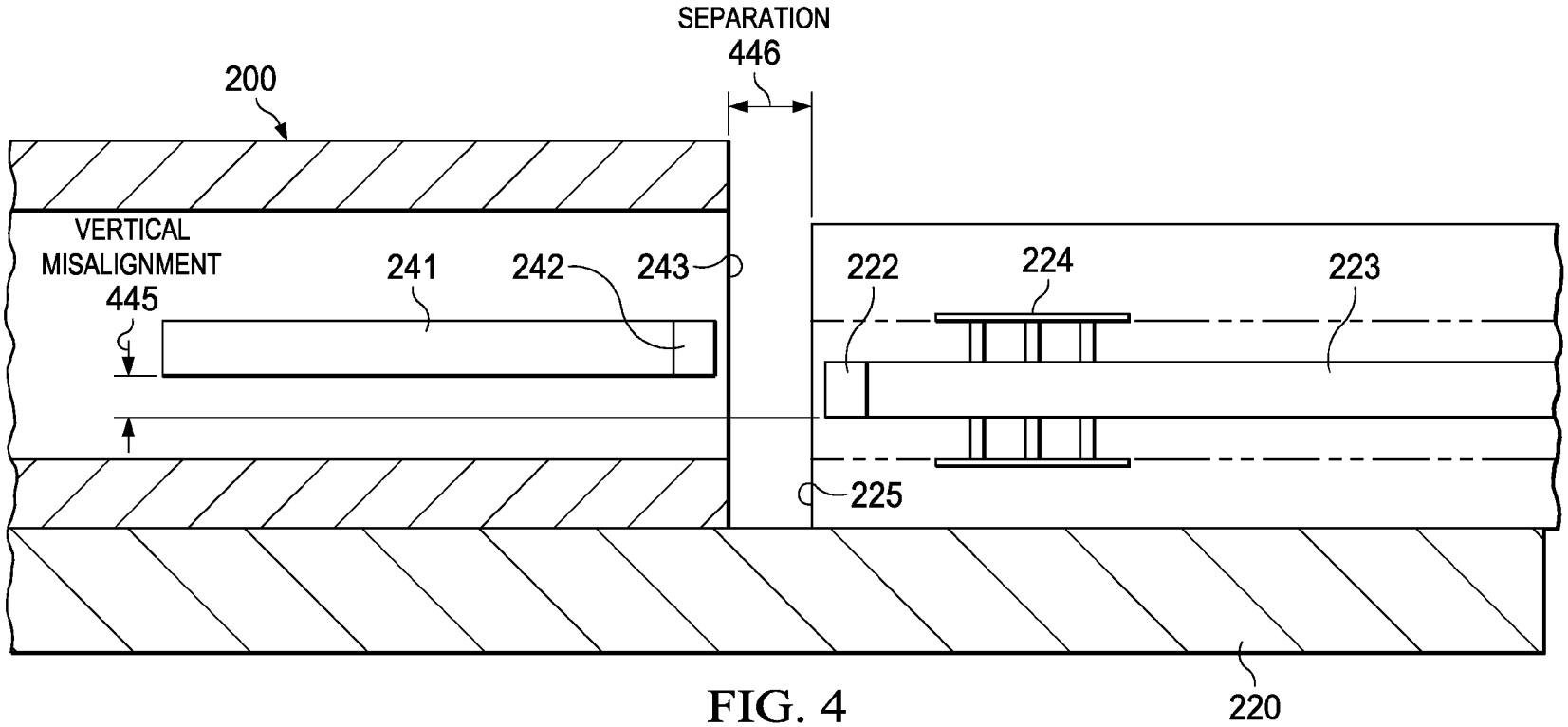

FIG. 3 illustrates a top view and FIG. 4 illustrates a side view of the end of DWG 200 in more detail. DWG 200 may have a dielectric core 212 that may be surrounded by a dielectric cladding 210, as will be described in more detail below. In this example, DWG 200 is formed on a substrate 320, which may be the same substrate 220 on which high frequency circuitry 250 is formed, or it may be a separate substrate, depending on the system design. Dipole antenna 242 and radiating element 241 may be fabricated directly in the end of DWG 200 adjacent to an interface plane 243 that forms the end of DWG 200. Dipole antenna 242 and radiating element 241 may be a metallic or dielectric-based resonant radiating element or a wideband radiating element, for example. Dipole antenna 242 and radiating element 241 may both be fabricated form a conductive material, such as metal, a conductive ink with metallic filler, a conductive polymer formed by ionic doping, carbon and graphite based compounds, conductive oxides, etc., for example.

In this example, DWG 200 with embedded dipole antenna 242 and radiating element 241 may be fabricated on a substrate by directly printing the dipole antenna and radiating elements into the end of a printed dielectric waveguide during fabrication of DWG 200, as will be described in more detail below. This is made possible by a layer-by-layer methodology used in additive fabrication techniques such as inkjet-printing. Other additive techniques such as screen-printing, flexographic printing, or 3D printing, for example, may be used. The substrate may range from a die, package, or board, to a substrate as simple as paper, for example.

A printed dielectric forms the core of the waveguide. The printed dielectric can be composed of any insulating material which can be deposited in thick layers (polymers, oxides, etc.). The dielectric material may be deposited as a single bulk material with relative permittivity $\in r1$ and relative permeability $\mu r1$, or in multiple layers to form a graduated-permittivity/permeability core with relative permittivities/permeability of $\in r1$-$\in rn$, $\mu r1$-$\mu rn$. The grading can be attained via use of different materials, or nanoparticle doping, for example.

Referring to FIG. 4, coupling generated between launching antenna 222 and receiving antenna 242, or vice versa, allows a significant amount of separation to exist between antenna 222 and antenna 242 while still maintaining a good coupling ratio. There may be vertical misalignment 445 and/or a separation distance 446, for example. There may also be a sideways misalignment, which is not illustrated in this figure. Experiments have shown that a separation of up to approximately ten wavelengths of the signal being transmitted may be tolerated and still provide good signal transmission.

Figure 5:
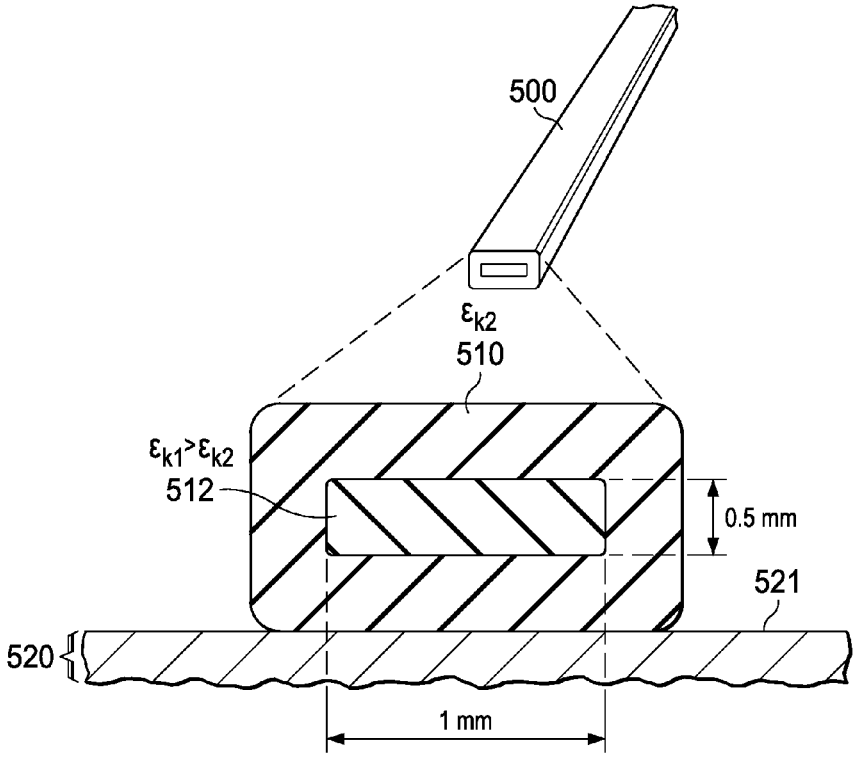
FIGS. 5-7 are illustrations of example waveguides.

FIG. 5 illustrates a DWG 500 that is configured as a thin ribbon of a core dielectric material 512 surrounding by a dielectric cladding material 510. The core dielectric material has a dielectric constant value $\in 1$, while the cladding has a dielectric constant value of $\in 2$, where $\in 1$ is greater than $\in 2$. For sub-terahertz signals, such as in the range of 130-150 gigahertz, a core dimension of approximately 0.5 mm×1.0 mm works well. DWG 500 may be fabricated conformably onto surface 522 of substrate 520 using an inkjet printing process or other 3D printing process described in more detail below. As the dielectric waveguide is being fabricated with a single dielectric material, a radiating element may be fabricated in-line with the process to produce an embedded matching and proximity coupled radiating element, as discussed above in more detail.

In this example, dielectric clad DWG 500 is fabricated on a surface 522 of a substrate 520, as will be explained in more detail below. This substrate may range from an integrated circuit (IC) die, a substrate in a multi-chip package, a printed circuit board (PCB) on which several ICs are mounted, etc., for example. The substrate may be any commonly used or later developed material used for electronic systems and packages, such as: silicon, ceramic, Plexiglas, fiberglass, plastic, metal, etc., for example. The substrate may be as simple as paper, for example.

Figure 6:
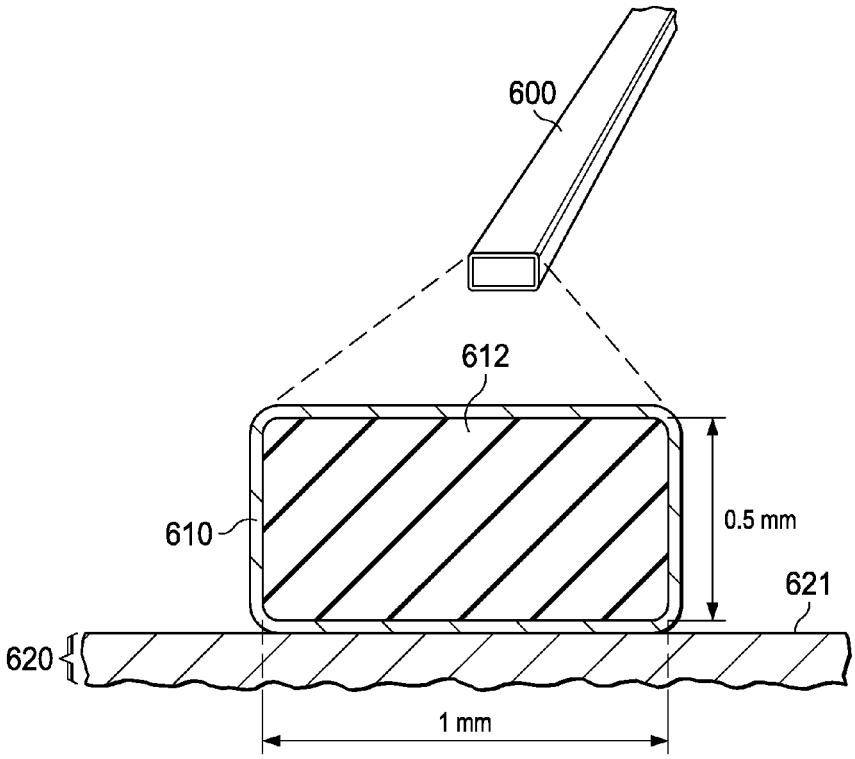

FIG. 6 illustrates a metallic, or other conductive material, clad DWG 600 that is configured as a thin ribbon of the core material 612 surrounding by the metallic cladding material 610. For sub-terahertz signals, such as in the range of 130-150 gigahertz, a core dimension of approximately 0.5 mm×1.0 mm works well. As the dielectric waveguide is being fabricated with a single dielectric material, a radiating element may be fabricated in-line with the process to produce an embedded matching and proximity coupled element, as discussed above in more detail.

In this example, metallic clad DWG 600 is fabricated on a surface 622 of a substrate 620. This substrate may range from an integrated circuit (IC) die, a substrate in a multi-chip package, a printed circuit board (PCB) on which several ICs are mounted, etc., for example. The substrate may be any commonly used or later developed material used for electronic systems and packages, such as: silicon, ceramic, Plexiglas, fiberglass, plastic, metal, etc., for example. The substrate may be as simple as paper, for example.

Figure 7:
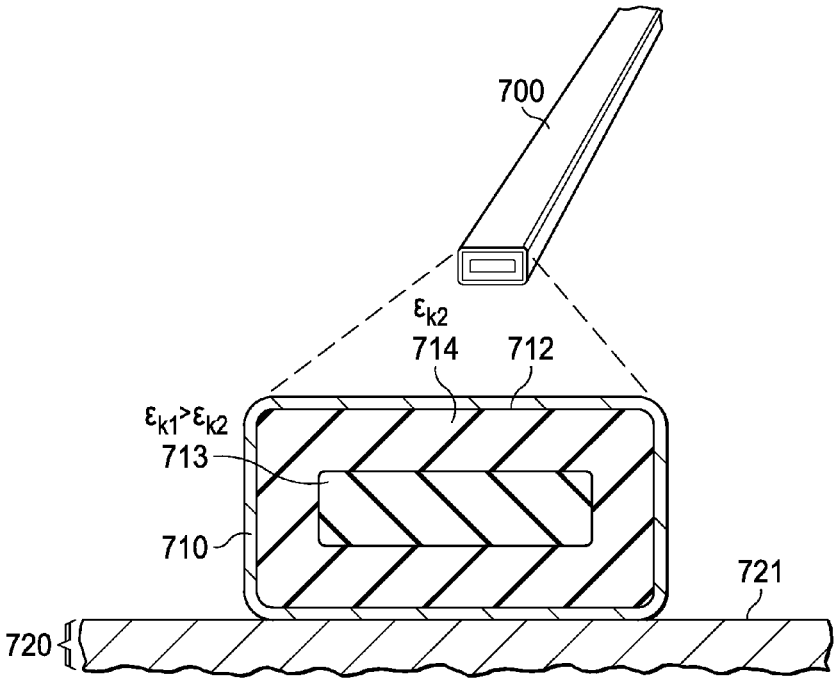

FIG. 7 illustrates a metallic, or other conductive material, clad DWG 700 that is configured as a thin ribbon of the core 712 surrounding by the metallic cladding material 710. In this example, core 712 is comprised of a thin rectangular ribbon of the core material 713 that is surrounded by a second layer of core material 714 to form a graded core 712. Core region 713 has a dielectric constant value of $\in k1$, while core region 714 has a dielectric constant value of $\in k2$, where $\in k1 > \in k2$. In another embodiment, graded core 712 may comprise more than two layers of core material, with each layer having a different relative dielectric constant value ranging from relative permittivity of $\in r1$-$\in rn$, for example. In another example, the graded core may be implemented in such a manner that the dielectric constant value gradually varies from a higher value in the center to a lower value at the outside edge. In this manner, a graded core may be provided that tends to confine the sub-THz frequency signal to the core material and thereby reduce cutoff effects that may be produced by the metallic cladding, for example. As the dielectric waveguide is being fabricated with a graded index dielectric material, a radiating element may be fabricated in-line with the process to produce an embedded matching and proximity coupled element, as discussed above in more detail.

In this example, metallic clad DWG 700 is fabricated on a surface 722 of a substrate 720. This substrate may range from an integrated circuit (IC) die, a substrate in a multi-chip package, a printed circuit board (PCB) on which several ICs are mounted, etc., for example. The substrate may be any commonly used or later developed material used for electronic systems and packages, such as: silicon, ceramic, Plexiglas, fiberglass, plastic, metal, etc., for example. The substrate may be as simple as paper, for example.

Figure 8:
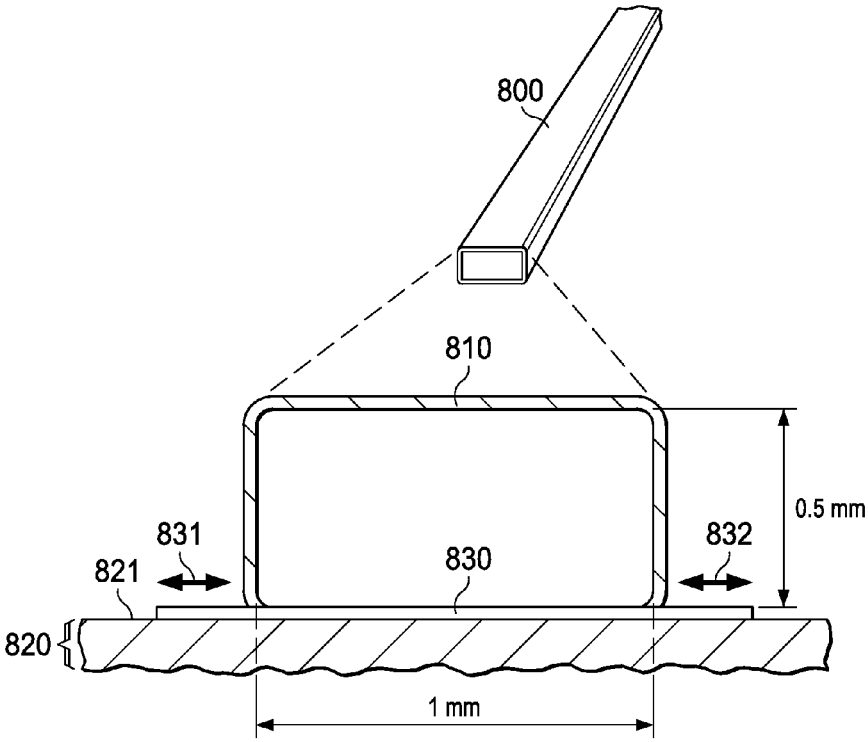
FIG. 8 illustrates another embodiment of any of the waveguides of FIGS. 5-7.

FIG. 8 illustrates another embodiment 800 of any of the waveguides of FIGS. 5-7. In this example, waveguide 800 is fabricated on a surface 822 of a substrate 820. This substrate may range from an integrated circuit (IC) die, a substrate in a multi-chip package, a printed circuit board (PCB) on which several ICs are mounted, etc., for example. The substrate may be any commonly used or later developed material used for electronic systems and packages, such as: silicon, ceramic, Plexiglas, fiberglass, plastic, metal, etc., for example. The substrate may be as simple as paper, for example.

For a metallic clad waveguide, such as those illustrated in FIGS. 6-7, a bottom portion of waveguide 800 may be formed by a conductive layer 830 that may extend along surface 822 beyond a footprint of waveguide 800, as indicated at 831, 832, for example. For a non-metallic DWG such as illustrated in FIG. 5, a bottom portion of waveguide 800 may be formed by a dielectric layer 830 that may extend along surface 822 beyond a footprint of waveguide 800, as indicated at 831, 832, for example. In either case, the extent of regions 831, 832 may be minimal, or they may cover an extended portion of surface 822, or even the entire surface 822, for example. Conductive layer 830 may be metallic or may be a conductive non-metallic material, for example.

Embodiments of the invention may be implemented using any of the dielectric core waveguides described above, for example. In each embodiment, an embedded radiating element will be formed at the end of the waveguide, as described above in more detail, in order to improve signal coupling efficiency with a signal launching mechanism.

The various dielectric core waveguide configurations described above may be fabricated using a printing process, such as an inkjet printer or other three dimensional printing mechanism. Fabrication of three dimensional structures using ink jet printers or similar printers that can "print" various polymer materials is well known and need not be described in further detail herein. For example, see "3D printing," Wikipedia, Sep. 4, 2014. Printing allows for the rapid and low-cost deposition of thick dielectric and metallic layers, such as 0.1 um-1000 um thick, for example, while also allowing for fine feature sizes, such as 20 um feature sizes, for example. Standard integrated circuit (IC) fabrication processes are not able to process layers this thick. Standard macroscopic techniques, such as machining and etching, typically used to manufacture dielectric waveguides and metallic structures may only allow feature sizes down to 1 mm, for example. These thicker printed dielectric and metallic layers on the order of 100 nm-1 mm which are made possible by inkjet printing enable waveguide operation at Sub-THz and THz frequencies. Previously optical frequencies could be handled using standard semiconductor fabrication methods while lower frequencies may be handled using large metallic waveguides; however, there was a gap in technology for fabricating waveguides for THz signals. Printing the waveguides directly onto the chip/package/board mitigates alignment errors of standard waveguide assemblies and simplifies the packaging process.

Figure 9:
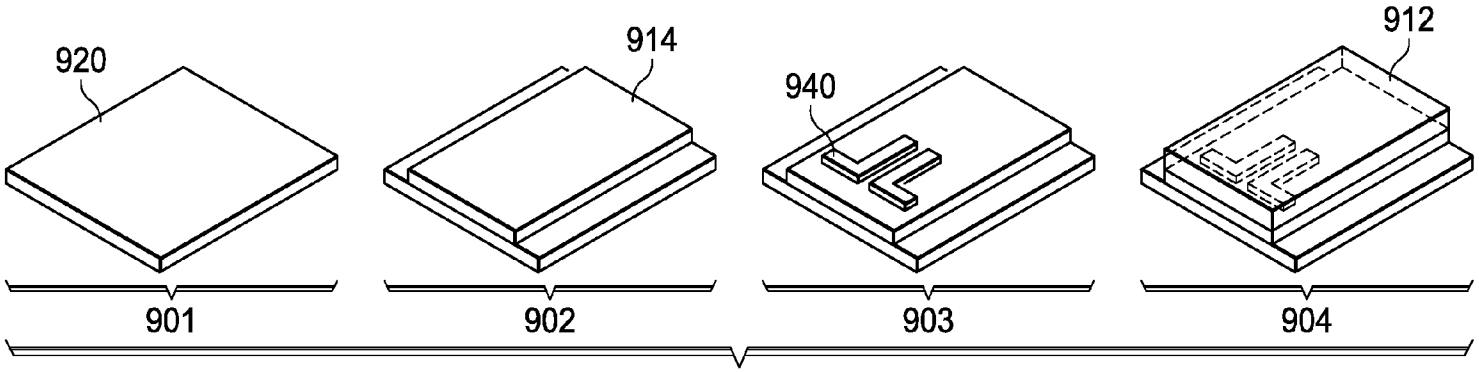
FIGS. 9-12 are process flow diagrams illustrating fabrication of various configurations of waveguides using a three dimensional printing process.

FIG. 9 is a process flow diagrams illustrating fabrication of a waveguide with a dielectric core similar to FIG. 5 and FIG. 6 using an additive fabrication process, such as inkjet printing, for example. Other additive techniques such as screen-printing, flexographic printing, or 3D printing may be used, for example. Step 901 shows a substrate 920. As discussed in more detail above, the substrate may range from a die, package, or board, to a substrate as simple as paper, for example.

During step 902, a bottom portion 914 of a dielectric core is formed on a surface of the substrate. In the plane of the substrate, waveguides may be printed arbitrarily long in any desired pattern. Printed waveguides may conform to the surface topology of the substrate. While not illustrated here, one or more additional layers may be formed on the substrate to form a conductive or dielectric cladding around the dielectric core.

During step 903, as the dielectric waveguide is being fabricated with a single dielectric material, a radiating element 940 may be fabricated in-line with the process to produce an embedded matching and proximity coupled element.

During step 904, another layer of dielectric core material is deposited over lower portion 914 and radiating element 940 to form the completed dielectric core 912.

Figure 10:
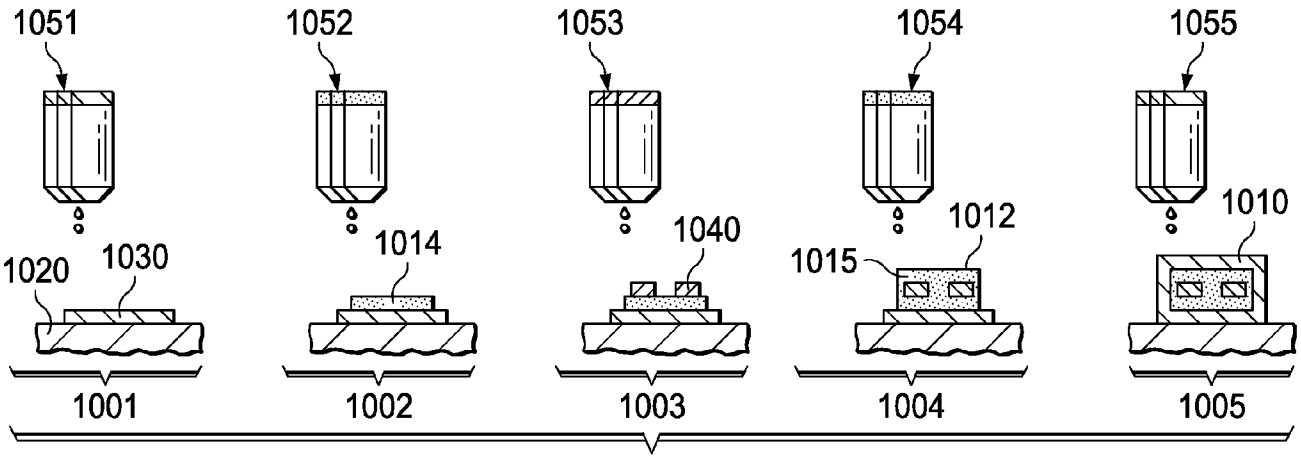

FIG. 10 is a more detailed process flow diagram illustrating fabrication of a waveguide with a dielectric core similar to FIG. 5 and FIG. 6 using an ink jet printing process. FIG. 10 provides an end view of the waveguide. In process step 1001, an inkjet printing mechanism illustrated at 1051 deposits a bottom layer 1030 on a top surface of a substrate 1020 using a known printing process. This bottom layer will form a bottom surface of the waveguide cladding. Bottom layer 1030 may be a dielectric layer for forming a dielectric waveguide similar to DWG 500. The dielectric material for the bottom portion 1014 of core 1012 may be deposited as a single bulk material with relative permittivity $\in k2$, for example, referring back to FIG. 5. Similarly, bottom layer 1030 may be a conductive layer for forming a conductive waveguide similar to DWG 600. Bottom layer 1030 may be configured so that it only extends across the bottom region of the wave guide, as illustrated in FIGS. 5-6, or it may be configured to extend beyond the walls of the waveguide, as illustrated in FIG. 8. Bottom layer 1030 extends the length of the waveguide and conforms to the top surface of substrate 1020.

In another embodiment, bottom layer 1030 may be prefabricated on the substrate; for example, it may be a conductive layer that is laminated on the surface of substrate 1020. In this example, unneeded portions of the conductive layer may be removed by etching, for example, or by other known fabrication techniques for creating patterned features on a substrate. In another embodiment, bottom layer 1030 may be formed by diffusion of a layer onto substrate 1020, or by sputtering a layer onto substrate 1020, or by flooding the surface of substrate 1020 with a liquid or paste, etc., for example. In another embodiment, a stamped metal or dielectric shape may be laminated or otherwise affixed to substrate 1020 to form bottom layer 1030

In process step 1002, a dielectric material may be applied by print-head 1052 to form the bottom portion 1014 of the core of the waveguide. Multiple passes of print-head 1052 may be required to obtain a desired thickness for core portion 1014. The printed dielectric may be composed of any dielectric material which can be deposited in thick layers, such as polymers, oxides, etc., for example. The dielectric material for the bottom portion 1014 of core 1012 may be deposited as a single bulk material with relative permittivity $\in k1$, for example, referring back to FIG. 5.

During process step 1003, a conductive material may be applied by print-head 1053 produce an embedded matching and proximity coupled element 1040. Various conductive materials that can be printed in this manner may be used to form radiating element 1040, such as: a conductive ink with metallic filler, a conductive polymer formed by ionic doping, carbon and graphite based compounds, conductive oxides, etc., for example.

During process step 1004, another layer 1015 of dielectric material may be formed over the lower portion 1014 and radiating element 1040 by print-head 1054 to form the completed dielectric core 1012. Multiple passes of print-head 1054 may be required to obtain a desired thickness for core 1012

During process step 1005, a conformal cladding coating may be applied by print-head 1055 to cover the top and sides of the waveguide. In this manner, core 1012 is enclosed with a conductive cladding 1010 or a dielectric cladding to form a waveguide. Various conductive materials that can be printed in this manner may be used to form coating 1010, such as: a conductive ink with metallic filler, a conductive polymer formed by ionic doping, carbon and graphite based compounds, conductive oxides, etc., for example. Similarly, a dielectric material similar to base layer 1030 may be used to form the cladding for a non-conductive DWG, for example.

Figure 11:
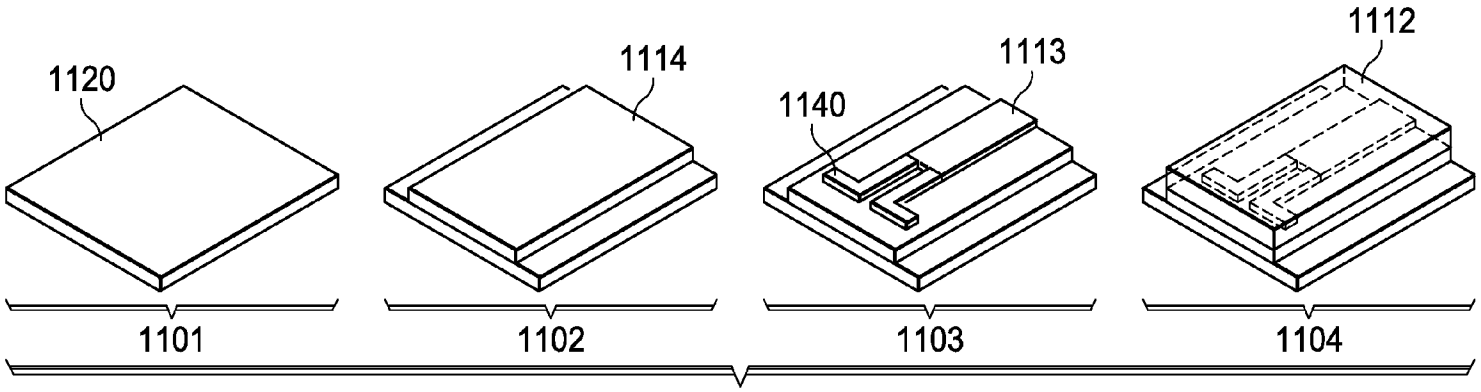

FIG. 11 is a process flow diagrams illustrating fabrication of a waveguide with a graded index dielectric core similar to FIG. 7 using an additive fabrication process, such as inkjet printing, for example. Other additive techniques such as screen-printing, flexographic printing, or 3D printing may be used, for example. Step 1101 shows a substrate 1120. As discussed in more detail above, the substrate may range from a die, package, or board, to a substrate as simple as paper, for example.

During step 1102, a bottom portion 1114 of a dielectric core is formed on a surface of the substrate having a dielectric constant value of $\in k2$. In the plane of the substrate, waveguides may be printed arbitrarily long in any desired pattern. Printed waveguides may conform to the surface topology of the substrate. While not illustrated here, one or more additional layers may be formed on the substrate to form a conductive or dielectric cladding around the dielectric core.

During step 1103, central region 1113 of the dielectric core is formed using a dielectric material that has a higher dielectric constant value $\in k1$ than the dielectric constant value $\in k2$ of layer 1114 to form a graded index core, referring to FIG. 7. As the dielectric waveguide is being fabricated with a graded index dielectric material, a radiating element 1140 may be fabricated in-line with the process to produce an embedded matching and proximity coupled element.

During step 1104, another layer of dielectric core material is deposited over lower portion 1114, central region 1113, and radiating element 1140 to form the completed dielectric core 1112.

Figure 12:
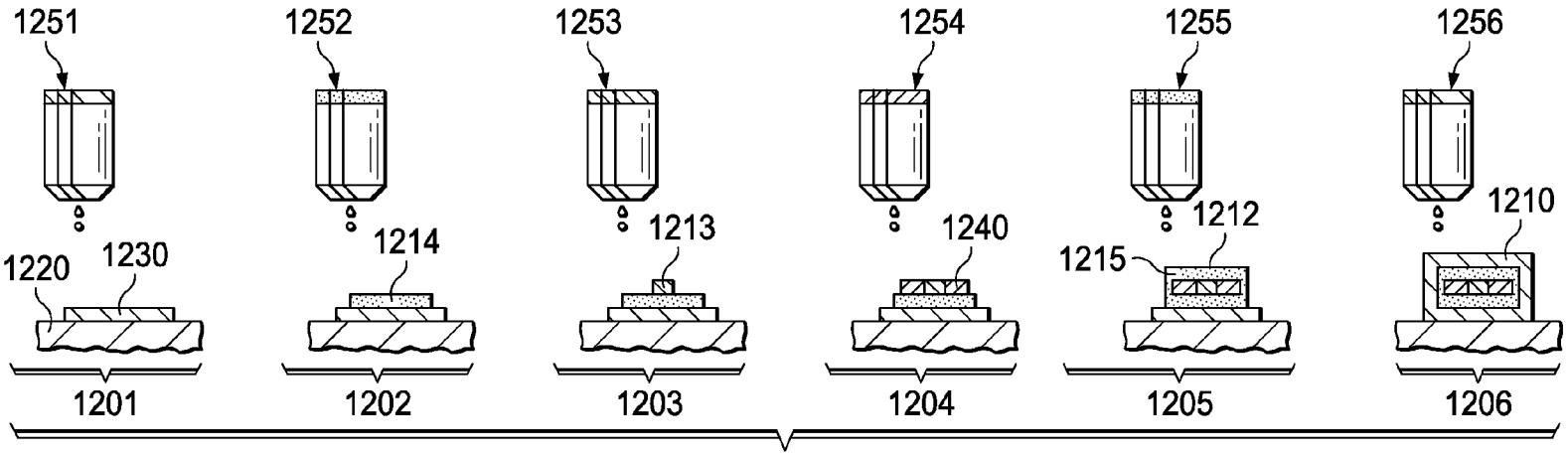

FIG. 12 is a more detailed process flow diagram illustrating fabrication of a metallic waveguide with a dielectric core similar to FIG. 7 using an ink jet printing process. In this example, a bottom cladding layer 1230 is formed on a top surface of substrate 1220 by a print-head 1251 during process step 1201, in a similar manner as described above with regard to FIG. 10. A first core layer 1214 is formed by print-head 1252 during process step 1202 in a similar manner as described above. The printed dielectric may be composed of any dielectric material which can be deposited in thick layers, such as polymers, oxides, etc., for example.

During process step 1203, a region 1213 of the core is formed by print-head 1253 using a dielectric material that has a different dielectric constant than the material used for layer 1214, as described in more detail above.

During process step 1204, a conductive material may be applied by print-head 1054 produce an embedded matching and proximity coupled radiating element 1240. Various conductive materials that can be printed in this manner may be used to form radiating element 1240, such as: a conductive ink with metallic filler, a conductive polymer formed by ionic doping, carbon and graphite based compounds, conductive oxides, etc., for example.

During process step 1205, another layer of dielectric material may be formed over the lower portion 1214, central portion 1213, and radiating element 1240 by print-head 1055 to form the completed dielectric core 1212. Multiple passes of print-head 1055 may be required to obtain a desired thickness for core 1212

In this example, three layers 1214, 1213, and 1215 are used to form core member 1212. In this example, layer 1213 has a relative dielectric constant value $\in r1$ that is greater than the relative dielectric constant value $\in r2$ of layers 1214, 1215. As discussed above, in this manner is graded core may be formed that allows the sub-THz signal to be more confined within the region of the dielectric core.

In another embodiment, additional layers may be used to form graded core member 1212 using a range of relative permittivity of $\in r1$-$\in rn$, for example.

During process step 1206, a printed conductive coating 1210 may be applied by print-head 1256 to cover the top and sides of the waveguide. In this manner, core 1212 is enclosed with a conductive cladding 1210 to form a waveguide, as discussed in more detail above.

For all of the waveguide embodiments described above, the waveguides may be printed arbitrarily long in a desired pattern in the plane of the substrate. Printed waveguides may conform to the surface topology of the substrate. If the substrate is flexible, the waveguide may also be flexible as long as the materials used to print the waveguide are also flexible.

In another embodiment, the dielectric core may be formed in a such a manner that the dielectric core has a dielectric constant value that varies over two or more values along the longitudinal extent of the dielectric core. This may be done by printing different materials along the extent of the dielectric core, for example. This may be useful for matching impedance of the waveguide to another waveguide, for example.

Typically, using a lithographic process to form the dielectric core would produce essentially vertical sidewalls on the dielectric core. Deposition of a metallic material to cover the dielectric core may be difficult when the sides of the dielectric core are vertical. However, using an inkjet process to form the dielectric core and controlling the surface tension of the ink allows the slope, or angle, of the sidewalls of the printed waveguide to be controlled. Thus, the sidewalls of the dielectric core may be formed with a slight inward slope, or may be formed perfectly vertical, depending on the needs of the next processing step. In this manner, deposition of the metallic sidewalls may be improved. This may not be an issue in other 3D printing processes, however.

Figure 13:
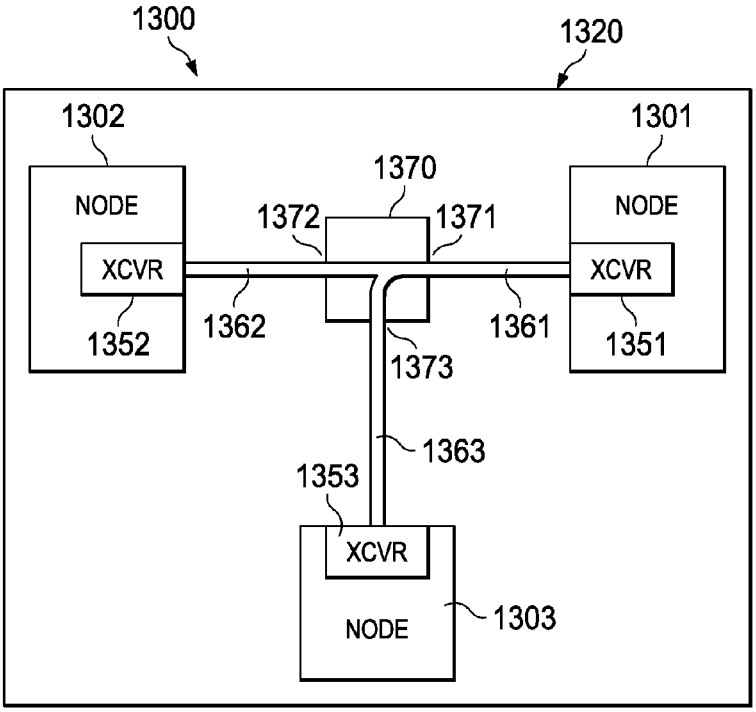
FIG. 13 is an illustration of three system nodes being interconnected with a dielectric core waveguide formed on a substrate.

FIG. 13 is an illustration of a system 1300 that has at three nodes 1301, 1302, and 1303 that are interconnected with DWGs 1361, 1362, 1363 using a signal divider 1370 that are all formed on a substrate 1320. An example signal divider is described in more detail in U.S. patent application Ser. No. 14/498,512, filed Sep. 26, 2014, entitled "Dielectric Waveguide Signal Divider", which is incorporated by reference herein. The three nodes may be a computing device and two peripheral devices or three computing devices, for example. The nodes may be any form of computing device, such as, but not limited to: a system on a chip (SOC), a rack mount, desk mount, or portable computer, a mobile user device such a notebook computer, a tablet computer, a smart phone, etc, for example. The nodes may be any type of peripheral device such as: a media storage device such as rotating or solid state disk drive, a modem or other interface to a high speed network, etc, for example. Each node may be an integrated circuit. All of the nodes may be mounted on a common circuit board substrate 1320, for example.

Each node 1301, 1302, 1303 may be an SOC or may contain a PWB (printed wiring board) or other type substrate on which are mounted one or more integrated circuits that produce or receive a sub-terahertz signal that is coupled to a DWG using transceivers 1351, 1352, 1353, for example. The manner of coupling between the IC and the DWG may be implemented using any of the techniques described in more detail in U.S. patent application Ser. No. 13/854,935, or later developed, for example.

Waveguides 1361, 1362, and 1363 may be any form of flexible or rigid DWG as described in more detail above, for example. Various system embodiments may have more or fewer nodes interconnected with waveguides that are formed on a substrate, for example. One or more of waveguides 1361, 1362, and 1363 may include an embedded radiating element as described above in more detail to improve signal coupling to the associated signal launching mechanism.

In some embodiments, one or more of segments 1361-1363 may have a metallic or otherwise conductive sidewalls, while one or more of segments 1361-1363 may be a dielectric waveguide in which the sidewall cladding is also a dielectric material having a lower dielectric constant value than the core region.

DWGs 1361, 1362, 1363 and signal divider 1370 may all be formed on a single substrate 1320 using an ink jet or another three dimensional printing process, for example. In another embodiment DWGs 1361, 1362, 1363, and signal divider 1370 may all be formed on a single substrate using PWB fabrication techniques with plating and etching, for example. In another embodiment, DWGs 1361, 1362, 1363 and signal divider 1370 may be formed using diffusion techniques to produce different dielectric constant values in a polymer material, for example.

In some embodiments, substrate 1320 may be silicon, or other semiconductor or insulator material, or a single integrated circuit that includes multiple functional nodes, often referred to as a system on a chip (SoC). In that case, the SoC may include an antenna or other coupling structure in a node such as node 1301, an antenna, or other coupling structure in a second node such as node 1302, with a DWG coupled between the two nodes formed directly on the SoC substrate.

Figure 14:
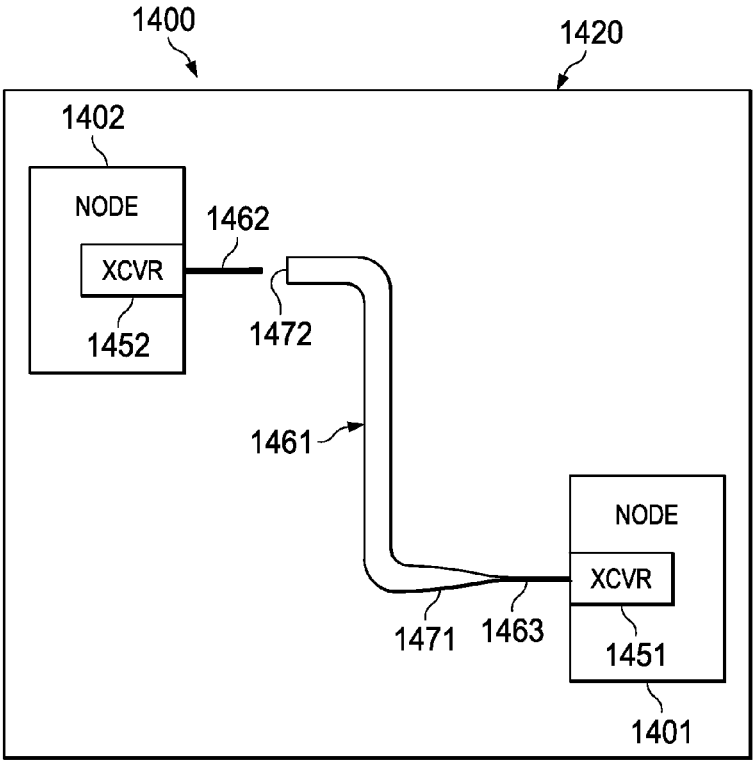
FIG. 14 is an illustration of a system in which the cross-section of a waveguide changes along its length.

FIG. 14 is an illustration of a system 1400 in which the cross-section of a waveguide changes along its length. In this example, two nodes 1401, 1402 with transceivers 1451, 1452 are mounted or otherwise formed on a surface of substrate 1420, as described in more detail above. Transceiver 1451 is coupled to transceiver 1452 by a waveguide that is also formed on the surface of substrate 1420 as described in more detail above.

In this example, the waveguide includes three segments 1461, 1462, 1463 that conform to the surface of substrate 1420. Since the waveguide segments may be fabricated using an inkjet process or other 3D printing process, the cross section of the segments may be easily varied to optimize transmission properties, for example. Each segment 1461-1463 may have different properties, such as cross section size, (width×height), cross section aspect ratio (width vs. height), dielectric constant, etc., for example. In another embodiment, a DWG segment may be designed to have a different impedance than another DWG segment. For example, a higher permittivity/permeability section of DWG may be used to form a corner or bend in a DWG in order to reduce signal radiation at the corner/bend.

At some locations, such as location 1471, a transition zone may be provided to gradually transition from one waveguide configuration to the next. The transition zone may have a length that is greater than several wavelengths of a target signal, for example.

At some locations, such as location 1472, adjoining waveguide segments may include an embedded radiating element as described above in more detail to improve signal coupling between the two waveguide segments, for example. In this case, the embedded radiating element may be designed to match the impedance characteristic of the waveguide segment in which it is embedded, for example.

Waveguide segments 1461, 1462 may include an embedded radiating element as described above in more detail to improve signal coupling to the associated signal launching mechanism in transceivers 1451, 1452, for example.

In some embodiments, one or more of segments 1461-1463 may have a metallic or otherwise conductive sidewalls, while one or more of segments 1461-1463 may be a dielectric waveguide in which the sidewall cladding is also a dielectric material having a lower dielectric constant value than the core region, for example.

Figure 15:
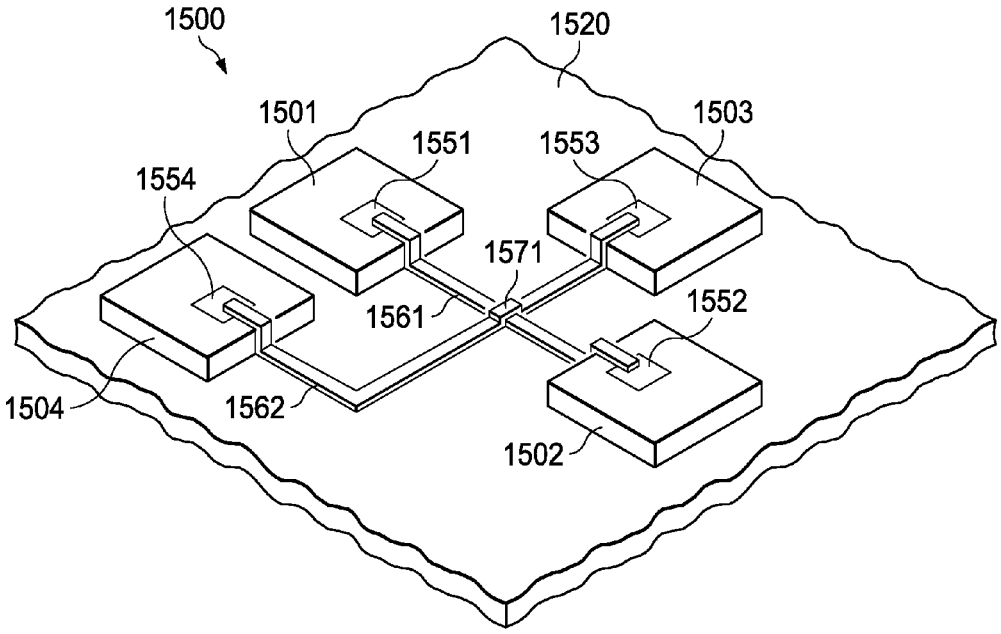
FIG. 15 is an illustration of a system illustrating various aspects of conformal waveguides.

FIG. 15 is an illustration of a system 1500 illustrating various aspects of conformal waveguides. In this example, four nodes 1501-1504 with transceivers 1551-1554 are mounted or otherwise formed on a surface of substrate 1520, as described in more detail above. Transceiver 1551 is coupled to transceiver 1552 by a waveguide 1561 that is also formed on the surface of substrate 1520 as described in more detail above. Likewise, transceiver 1553 is coupled to transceiver 1554 by a waveguide 1562 that is also formed on the surface of substrate 1520 as described in more detail above.

As described in more detail above, waveguides 1561, 1562 may be formed directly on the surface of substrate 1520 using an inkjet process or other form of 3D printing. This process allows the wave guides to be formed on a chip die of each node and to then follow over the edge of each die an onto the surface of substrate 1520. In a similar manner, one waveguide, such as 1562, may be routed over the top of another waveguide, such as 1561, as indicated at 1571, for example.

In some embodiments, substrate 1520 may be a single integrated circuit that includes multiple functional nodes in a single SoC. In that case, the SoC may include an antenna or other coupling structure in each node such as node 1501-1504, with one or more DWGs coupled between the two nodes formed directly on the SoC substrate.

In this manner, a wide degree a freedom is available to route multiple waveguides on a surface of the substrate, and to cross over other waveguides or other physical features that are present on the surface of the substrate.

In the various embodiments described above, an embedded radiating element may be formed in the end of one or more of waveguides 1561, 1562 as described in more detail above in order to improve signal coupling to signal launching mechanisms provided by nodes 1501-1504, for example.

Figure 16:
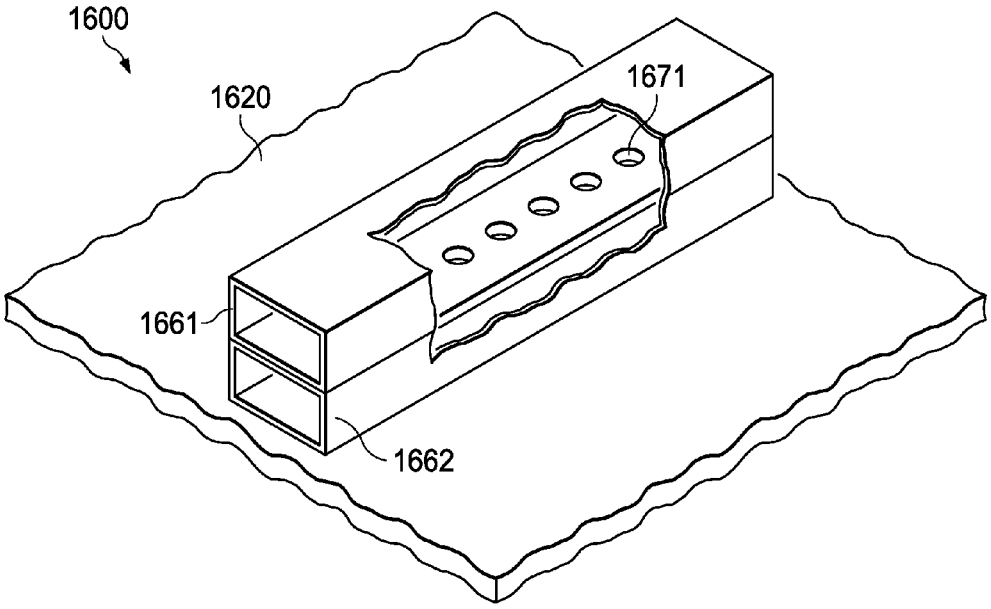
FIG. 16 is an illustration of two waveguides that are stacked.

FIG. 16 is an illustration of two waveguides 1661, 1662 that are stacked. Due to the digital nature of printing waveguides, multiple waveguides may be printed on top of each other, next to each other, overlapping, etc. This allows flexibility to not only create 3D signal routing schemes, but also create couplers, filters, etc. This may be done by repeating the steps illustrated in FIGS. 9-12 for each additional layer of waveguide, for example. In this manner, radiating elements may be embedded in the end of each one of a set of stacked waveguides, for example.

In this example, a set of holes 1671 may be formed between waveguide 1661 and 1662 during the printing process by simply omitting material to form each hole. In this manner, a signal propagating along waveguide 1661 may be coupled into waveguide 1662, or vice versa, for example.

Figure 17:
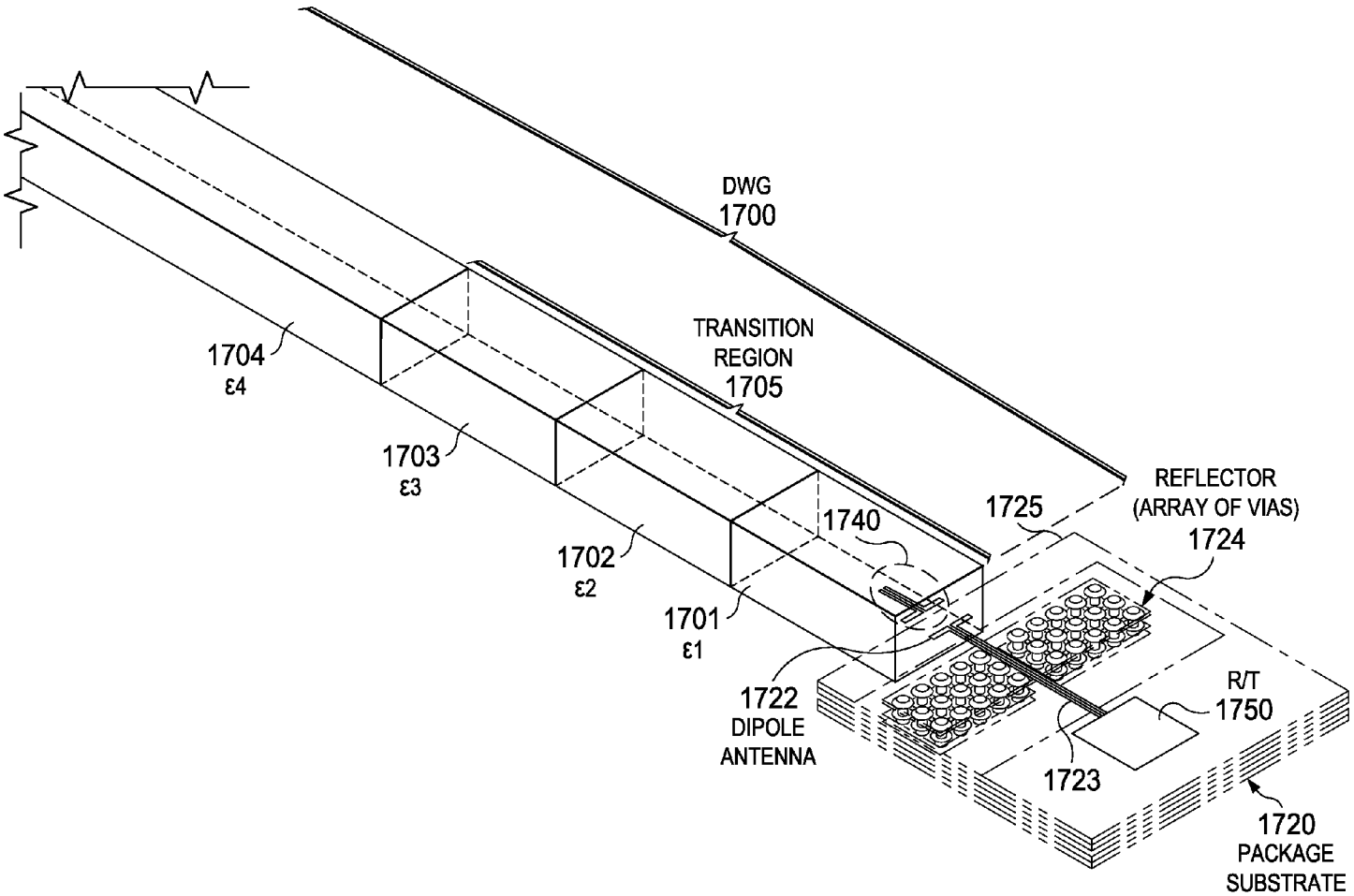
FIG. 17 is an illustration of a dielectric waveguide with varying dielectric constant values along the direction of propagation.

FIG. 17 is an illustration of a system that includes a dielectric waveguide with varying dielectric constant values along the direction of propagation. In this example system, an integrated circuit (IC) includes high frequency circuitry 1750 that produces a signal that is connected to a dipole antenna 1722 that is configured to launch an electromagnetic signal into an adjacent DWG 1700. In this example, high frequency circuitry 1750 is a transceiver that includes both a transmitter and receiver coupled to the same dipole antenna; however, in another embodiment high frequency circuitry 1750 may only include a transmitter or only a receiver. In this example, substrate 1720 may be part of the IC, or the IC may be mounted on substrate 1720. An edge of substrate 1720 forms an interface area 1725 where the dipole antenna is positioned. A microstrip line 1723 couples the dipole antenna to high frequency circuitry 1750. A reflector 1724 is provided to cause electromagnetic energy that radiates from the back side of dipole antenna 1722 to be reflected back towards DWG 1700 in order to improve signal coupling into DWG 1700. DWG 1700 will typically have an outer layer, but for simplicity the outer layer is not shown in this illustration. The outer layer may be another dielectric material that has a lower dielectric constant value than the core, or the outer layer may be a metallic or otherwise conductive layer, for example.

As discussed above, it is beneficial to match the impedance of a dielectric waveguide with its launching mechanism, such as dipole antenna 1722 in this example. This is necessary in order to allow an optimum power transfer of the signal between the antenna and the dielectric waveguide. As discussed above in more detail, an impedance matching radiating element 1740 may be embedded in the end of waveguide 1700. However, it some embodiments it may be difficult to fully match the impedance of the waveguide using just an impedance matching radiating element. In this case, a transition region 1705 may also be provided to improve matching of impedance between waveguide 1700 and dipole antenna 1722.

In terms of the parameters of an electromagnetic wave and the medium it travels through, the wave impedance is given by equation (2).

$$Z = \sqrt{\frac{j\omega\mu}{\sigma + j\omega\varepsilon}} \tag{2}$$

where μ is the magnetic permeability, ∈ is the electric permittivity and σ is the electrical conductivity of the material the wave is travelling through. In the equation, j is the imaginary unit, and ω is the angular frequency of the wave. In the case of a dielectric, where the conductivity is zero, equation (2) reduces to equation (3).

$$Z = \sqrt{\frac{\mu}{\varepsilon}} \tag{3}$$

For a hollow metallic waveguide, the ratio of the transverse electric field to the transverse magnetic field for a propagating mode at a particular frequency is the waveguide impedance. For any waveguide in the form of a hollow metal tube, (such as rectangular guide, circular guide, or double-ridge guide), the wave impedance of a travelling wave is dependent on the frequency, but is typically the same throughout the guide. For transverse electric (TE) modes of propagation the wave impedance may be defined by equation (4).

$$Z = \frac{z_0}{\sqrt{1 - \left(\frac{fc}{f}\right)^2}} \tag{4}$$

where $Z_0$ is the wave impedance of plane waves in free space and fc is the cut-off frequency of the propagation mode. For transverse magnetic (TM) modes of propagation the wave impedance may be given by equation (5).

$$Z = Z_0\sqrt{1 - \left(\frac{fc}{f}\right)^2} \tag{5}$$

For a dielectric filled metallic waveguide, the analysis is similar, except the characteristic wave impedance through the dielectric is used rather than that of free space. However, in a pure dielectric waveguide, the situation is more complicated and becomes a function of the transverse spatial coordinates. See, for example, C. Yeh, "The Essence of Dielectric Waveguides," 2008, pages 46-47.

Polymer material commonly used to fabricate the dielectric core of a waveguide has a dielectric constant value that is typically in the range of 2.4-12, with lower values being more common and therefore less expensive. The impedance of a DWG using a commonly available polymer material having a dielectric constant of approximately 3.0 for signals in the range of 100 GHz is approximately 200-500 ohms. A dipole antenna such as antenna 1722 may have a characteristic impedance of approximately 73 ohms, for example. Such a mismatch in impedance may reduce the coupling efficiency between antenna 1722 and a typical DWG.

As can be seen from equation (3), the impedance of a DWG may be changed by varying the permittivity and/or the permeability of the dielectric material. Embodiments of the invention may include a dielectric waveguide in which the dielectric constant and/or the permeability of the DWG is changed along the direction of propagation, as illustrated at 1701-1704. In order to have a maximum power transfer between the antenna and the DWG, the impedance of the DWG is gradually changed from the intrinsic impedance value produced by common polymer material to a value that better matches radiating element 1740 and thereby dipole antenna 1722 or other signal launching mechanism. In this manner, the return loss of the interface between the package and the DWG may be minimized.

As indicated in equation (3), the impedance of a dielectric core waveguide is a function of electric permittivity ($\in$); therefore, the impedance of the dielectric waveguide may be modified by changing the dielectric constant of the DWG within a transition region 1705. This may be achieved in a number of ways, such as using different dielectric materials having different permittivities, or by doping one type of polymer with micro or nano-particles of materials of higher dielectric constant, such as: BaTiO3 (barium titanate) or ZnO (zinc oxide), for example. Permittivity may be changed by anisotropic cross-linking of the same polymer such that cross-link density is changed with distance. Permeability may also be changed by doping or applying anisotropic magnetic fields to permeable materials.

Similarly, the impedance may be modified by changing the permeability of the DWG within the transition region 1705.

In this example, transition region 1705 includes three discrete sectors 1701, 1701, 1703 with different dielectric constants $\in 1$, $\in 2$, $\in 3$ that are selected to gradually adjust the impedance of each sector. The remainder of DWG 1700 has a dielectric constant $\in 4$ that is the intrinsic value provided by the polymer used to form the dielectric core.

Other embodiments may use more or fewer sectors to gradually adjust the impedance. In some embodiments, the transition region may have a gradual and continuous change in the dielectric constant to produce a smooth transition from a first impedance level at one end of the transition region to a second impedance level at an opposite end of the transition region. This may be implemented by gradually changing the concentration of dopants or microfillers along the length of the transition region.

A layer-by-layer additive fabrication technique such as inkjet-printing may be used to manufacture these steps of different dielectric constant polymers by printing the DWG directly onto a substrate, as described in more detail above. An initial sector 1701 may be printed with a polymer solution where the concentration of high dielectric constant particles produces a dielectric constant of $\in 1$ for this sector which results in an impedance of Z1. A second sector 1702 may be printed with the same polymer solution but with a different concentration of doping material such that the dielectric constant is $\in 2$ and the impedance Z2.

It can be demonstrated that the power transfer will be maximum when the condition of equation (6) is met.

$$Z1=\sqrt{Z_{\text{antenna}}\times Z2} \tag{6}$$

The number of steps may be increased following the same rule, as illustrated in equation (7), until an optimum dielectric constant (and loss factor) is reached that may then be used to build the rest of the length of the DWG.

$$Z_{n+1}=\sqrt{Z_n\times Z_{n+2}} \tag{7}$$

This solution allows the geometry of the signal launching antenna to be maintained while varying the properties of the dielectric material to achieve the impedance matching in concert with impedance matching radiating element 1740. Other solutions to the problem of matching impedance are focused in changing the geometry of the design (traces, antennas etc.) or working with materials with fixed dielectric properties such as package substrates or PCBs (printed circuit boards). A problem with changing the geometry of the antenna is that in many cases, in order to match the DWG with the antenna design requires increasing or decreasing the size of the antenna to dimensions beyond the manufacturing capability or the standard dimensions for substrates and PCBs, for example.

As shown by the above descriptions and examples, multiple electronic devices may be easily interconnected to provide sub-terahertz communication paths between the electronic devices by using the techniques described herein.

Printable metallic waveguides on top of a chip, package, or board may be processed onto nearly any substrate (silicon, Plexiglas, plastic, paper, etc. . . . ). Printed dielectric layers on the order of 100 nm-1 mm which are made possible by inkjet printing enable waveguide operation at Sub-THz frequencies; previously only optical frequencies could be reached using standard fabrication methods. A metallic or otherwise conductive shell provides isolation over standard dielectric waveguides.

Thus, extremely low-cost and low-loss sub-THz signal routing waveguides may be printed onto nearly any substrate. Printing the waveguides directly onto the chip/package/board mitigates alignment errors of standard waveguide assemblies and simplifies the packaging process.

Thus, extremely low-cost and low-loss sub-THz signal routing waveguides may be rapidly printed onto nearly any substrate, such as on top of IC's to integrate directly with circuits, on boards to interface components, etc., for example. With an embedded radiating element, high efficiency energy transfer becomes possible between two waveguides placed within proximity, or waveguides placed in proximity to an IC which has a radiating element to transmit energy.

As described above, an embedded radiating element may accept radiated energy from a source, and re-orient the fields to match a preferred waveguide mode for exciting a target DWG. This may provide effective impedance matching between an EM source and a target DWG. This removes the requirement for difficult impedance matching techniques between waveguide segments, such as waveguides with different characteristic impedances, or waveguides and ICs, for example.

Other Embodiments

While the invention has been described with reference to illustrative embodiments, this description is not intended to be construed in a limiting sense. Various other embodiments of the invention will be apparent to persons skilled in the art upon reference to this description. For example, while a dielectric waveguide has been described herein, another embodiment may use a metallic or non-metallic conductive material to form the top, bottom, and sidewalls of the waveguide, such as: a conductive polymer formed by ionic doping, carbon and graphite based compounds, conductive oxides, etc., for example. As used herein, the term "conductive waveguide" refers to a waveguide having either metallic or non-metallic conductive sidewalls. In this case, an embedded radiating element may accept radiated energy from a source, and re-orient the fields to match a preferred waveguide mode for exciting a target metallic DWG. This may provide effective impedance matching between an EM source and a target metallic waveguide, for example.

While a portion of a radiating element embedded in a DWG was described herein as a dipole antenna, in another embodiment the antenna may be configured differently, such as a multi-element linear antenna, for example. The radiating element may be a metallic or dielectric-based resonant radiating element or a wideband radiating element, for example.

While DWGs and metallic or otherwise conductive waveguides are described herein, the inkjet and 3D printing techniques described herein may also be used to form other forms of waveguides, micro-coax, etc., for example that conform to a surface of a substrate.

While waveguides with polymer dielectric cores have been described herein, other embodiments may use other materials for the dielectric core, such as ceramics, glass, etc., for example. A transition region in a ceramic core waveguide may be formed by using ceramics with different permittivities, for example.

The substrate on which a dielectric core waveguide is formed may be rigid or flexible, planar or non-planar, smooth or irregular, etc., for example. Regardless of the topology of the substrate, the dielectric core waveguide may be formed on the surface of the substrate and conform to the topology of the surface by using the additive processes described herein.

While dielectric cores with a rectangular cross section are described herein, other embodiments may be easily implemented using the printing processes described herein. For example, the dielectric core may have a cross section that is rectangular, square, trapezoidal, cylindrical, oval, or many other selected geometries. Furthermore, the processes described herein allow the cross section of a dielectric core to change along the length of a waveguide in order to adjust impedance, produce transmission mode reshaping, etc., for example.

In some embodiments, the substrate may be removed after forming a waveguide using the inkjet printing or other 3d printing process by dissolving the substrate with an appropriate solvent or melting a heat sensitive substrate, for example. In this manner, a free standing waveguide that may have a complicated shape may be formed using the ease of fabrication and optional material variations available as described herein.

The dielectric core of the conductive waveguide may be selected from a range of approximately 2.4-12, for example. These values are for commonly available dielectric materials. Dielectric materials having higher or lower values may be used when they become available.

While formation of a conductive waveguide by directly printing the waveguide onto the substrate using a layer-by-layer additive fabrication technique such as inkjet-printing is described herein, other additive techniques such as screen-printing, flexographic printing, or 3D printing may also be used.

Certain terms are used throughout the description and the claims to refer to particular system components. As one skilled in the art will appreciate, components in digital systems may be referred to by different names and/or may be combined in ways not shown herein without departing from the described functionality. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" and derivatives thereof are intended to mean an indirect, direct, optical, and/or wireless electrical connection. Thus, if a first device couples to a second device, that connection may be through a direct electrical connection, through an indirect electrical connection via other devices and connections, through an optical electrical connection, and/or through a wireless electrical connection.

Although method steps may be presented and described herein in a sequential fashion, one or more of the steps shown and described may be omitted, repeated, performed concurrently, and/or performed in a different order than the order shown in the figures and/or described herein. Accordingly, embodiments of the invention should not be considered limited to the specific ordering of steps shown in the figures and/or described herein.

It is therefore contemplated that the appended claims will cover any such modifications of the embodiments as fall within the true scope and spirit of the invention.

What is claimed is:

1. A method for transmitting a radio frequency signal in a dielectric waveguide, the method comprising:

receiving a first radiated radio frequency (RF) signal on a first portion of a radiating structure embedded in the end of a dielectric waveguide (DWG); and launching a second RF signal into the DWG from a second portion of the radiating structure embedded in the DWG;

wherein the first portion of the radiating structure has a first characteristic impedance configured to receive the first radiated high frequency radio (RF) signal and the second portion of the radiating structure has a second characteristic impedance configured to match the DWG.

2. A method for transmitting a radio frequency signal in a dielectric waveguide, the method comprising:

receiving a first radiated radio frequency (RF) signal on a first portion of a radiating structure embedded in the end of a dielectric waveguide (DWG); and launching a second RF signal into the DWG from a second portion of the radiating structure embedded in the DWG;

further comprising:

producing a source RF signal on an integrated circuit; and transmitting the first radiated RF signal from a transmitting antenna that is electrically coupled to receive the source RF signal from the integrated circuit;

wherein the first portion of the radiating structure is located less than ten wavelengths of the first RF signal from the transmitting antenna.

3. A system comprising a dielectric waveguide (DWG), wherein the DWG comprises:

a longitudinal dielectric core member, wherein the core member has a first dielectric constant value; and a radiating structure embedded within a portion of the core member adjacent an end of the DWG, wherein the radiating structure has a first portion with a first characteristic impedance configured to receive a first high frequency radio (RF) signal and has a second portion with a second characteristic impedance configured to radiate a second RF signal into the DWG.

4. The DWG of claim 3, wherein the dielectric core member comprises a graded index dielectric core having two or more layers of dielectric material each having a different dielectric constant value.

5. The DWG of claim 3, further comprising a cladding longitudinally surrounding the dielectric core member.

6. The DWG of claim 5, wherein the cladding is conductive.

7. The DWG of claim 3, wherein the first portion of the radiating structure is a dipole antenna and the second portion of the radiating structure is parallel radiating elements.

8. The system of claim 7, further comprising:

a packaged integrated circuit having a radio frequency (RF) circuit configured to transmit or receive an RF signal coupled to an antenna; and a substrate, wherein the integrated circuit is mounted on the substrate and the DWG is mounted on the substrate such that the radiating structure in the DWG is located less than approximately ten wavelengths of the RF signal from the antenna in the integrated circuit.

9. A method for forming a waveguide, the method comprising:

forming a bottom cladding layer for the waveguide on a surface of a substrate;

forming an elongated core having a first dielectric constant value for the waveguide on the bottom cladding layer;

forming a radiating structure within the core of the waveguide, wherein the radiating structure has a first portion with a first characteristic impedance configured to receive a first radiated high frequency radio (RF) signal and has a second portion with a second characteristic impedance configured to radiate a second RF signal into the elongated core; and forming sidewalls and a conformal top layer surrounding the elongated core region and in contact with the bottom layer.

10. The method of claim 9, wherein forming the elongated core comprises forming a graded core region having two or more different dielectric constant values.

11. The method of claim 9, wherein the bottom cladding layer is formed to match a footprint of the waveguide.

12. The method of claim 9, wherein the bottom cladding layer is formed to extend beyond a footprint of the waveguide.

13. The method of claim 9, wherein the base cladding layer, the sidewalls, and the top layer are formed by three dimensional printing onto the surface of the substrate.

14. The method of claim 9, further comprising forming a transition core region in the elongated core having a graduated dielectric constant value that gradually changes from the first dielectric constant value adjacent the body portion to a second dielectric constant.

15. The method of claim 9, further comprising removing the substrate after forming the waveguide.

* * * * *